United States Patent [19]

Kellner

[11] 3,997,008

[45] Dec. 14, 1976

[54] DRILL DIRECTOR

[75] Inventor: Jackson M. Kellner, Midland, Tex.

[73] Assignee: Smith International, Inc., Midland, Tex.

[22] Filed: June 9, 1975

[21] Appl. No.: 584,736

Related U.S. Application Data

[63] Continuation of Ser. No. 505,450, Sept. 13, 1974, abandoned, which is a continuation of Ser. No. 419,106, Nov. 26, 1973, abandoned.

[52] U.S. Cl. ..... 175/45; 175/61; 175/71; 175/94; 175/230

[51] Int. Cl.[2] ..... E21B 47/022; E21B 7/06

[58] Field of Search ..... 175/24, 61, 62, 73, 175/76, 81, 92, 94, 98, 236; 160/117.5

[56] References Cited

UNITED STATES PATENTS

| | | | |
|---|---|---|---|
| 556,718 | 3/1896 | Semmer | 175/94 |
| 2,946,578 | 7/1960 | De Smaele | 175/76 X |
| 3,023,821 | 7/1962 | Etherington | 175/81 |
| 3,088,532 | 5/1963 | Kellner | 175/230 |
| 3,126,971 | 3/1964 | Kellner et al. | 175/81 X |
| 3,180,436 | 4/1965 | Kellner et al. | 175/94 X |
| 3,298,449 | 1/1967 | Bachman et al. | 175/94 X |
| 3,326,305 | 6/1967 | Garrett et al. | 175/76 X |
| 3,376,942 | 4/1968 | Van Winkle | 175/81 |
| 3,460,639 | 8/1969 | Garrett | 175/230 |
| 3,561,549 | 2/1971 | Garrison et al. | 175/76 |
| 3,667,556 | 6/1972 | Henderson | 175/73 |
| 3,791,042 | 2/1974 | Bell | 175/45 |
| 3,823,787 | 7/1974 | Haworth et al. | 175/24 |
| 3,827,512 | 8/1974 | Edmond | 175/94 |
| 3,853,186 | 12/1974 | Dahl et al. | 175/24 X |
| 3,888,319 | 6/1975 | Bourne et al. | 175/24 X |

*Primary Examiner*—Ernest R. Purser
*Assistant Examiner*—Richard E. Favreau
*Attorney, Agent, or Firm*—Murray Robinson

[57] ABSTRACT

The casing of a drill motor is provided with a deflection barrel free to turn thereon to position the barrel relative to the motor to apply lateral force to the side of the motor directed along any desired radius. A gravity actuated mercury potentiometer connected to the barrel provides a barrel orientation responsive electric transmitter for remote indication of the barrel orientation in the hole being drilled. An annular piston drives a key longitudinally between a straight keyway carried by the barrel and a helical keyway carried by the motor to position the barrel azimuthally about the motor axis. A manifold connected to the motor provides means for making connection to fluid and electric conduits for operating the motor, the piston, and the transmitter.

23 Claims, 16 Drawing Figures

DRILL DIRECTOR

This is a continuation of prior application Ser. No. 505,450, filed Sept. 13, 1974, which is a continuation of prior application Ser. No. 419,106, filed Nov. 26, 1973, both now abandoned, and the priority of these two prior applications is claimed.

BACKGROUND OF THE INVENTION

1. Field of the Invention

This invention pertains to earth boring and more particularly to drill directing apparatus.

2. Description of Prior Art

It is known to drill a hole in the earth with a rotating bit. In such drilling the bit may be loaded axially either by the weight of the drill stem to which the bit is connected or by application of fluid pressure to a piston or cylinder connected to the drill stem anywhere along its length between the bit and the mouth of the hole. The bit can be rotated by a motor connected to the drill stem anywhere between its inner end adjacent the bit and its other or outer end, which may be out of the hole of the earth's surface. It is known to guide the bit of cause the hole to be bored in any desired direction. For example, in U.S. Pat. Nos. 3,298,449 to Bachman et al., 3,326,305 to Garret et al. and 3,460,639 to Garrett there is shown a bit deflection barrel around the drill stem and through which the drill stem moves axially as drilling proceeds, the drill stem being turned by an out of the hole motor. U.S. Pat. No. 2,637,527 to Andrews shows a deflection and force application barrel about a drill stem projectable into the hole as drilling proceeds and carrying an in-hole motor between the barrel and stem. It is also known to provide bit deflection means affixed to the bit or to the drill stem adjacent the bit, such deflection means moving axially in the hole as the bit proceeds. To take the reaction force of an in-hole bit loading device, an in-hole motor or a bit directing device it is known to provide anchor means to engage the wall of the hole being drilled. This is shown for example in U.S. Pat. No. 556,718 to Semmer which also shows means for advancing an in-hole motor and bit loading device along the hole as it is drilled. Another example of such anchor means is the construction shown in U.S. Pat. No. 2,946,578 to DeSmaele. See also Pats. to Kellner U.S. Pat. Nos. 3,088,532, 3,105,561, and to Kellner et al. U.S, Pat. Nos. 3,180,436, 3,180,437, and to Roberts U.S. Pat. No. 3,225,844.

SUMMARY OF THE INVENTION

According to the invention a deflection barrel is disposed about an in-hole motor, being free to turn thereabout to direct the motor in the desired azimuthal direction. Piston and cylinder driven key and slot means is provided between the motor and barrel for turning the barrel as desired relative to the motor. Orientation responsive transmitter means in the form of a mercury potentiometer mechanically connected to the barrel and electrically connected to an out of the hole Wheatstone bridge provides means to give a remote indication of the barrel orientation. A manifold is connected mechanically to the outer end of the barrel providing means for connecting fluid and electric conduits to the apparatus.

DESCRIPTION OF PREFERRED EMBODIMENT

Figure 1:
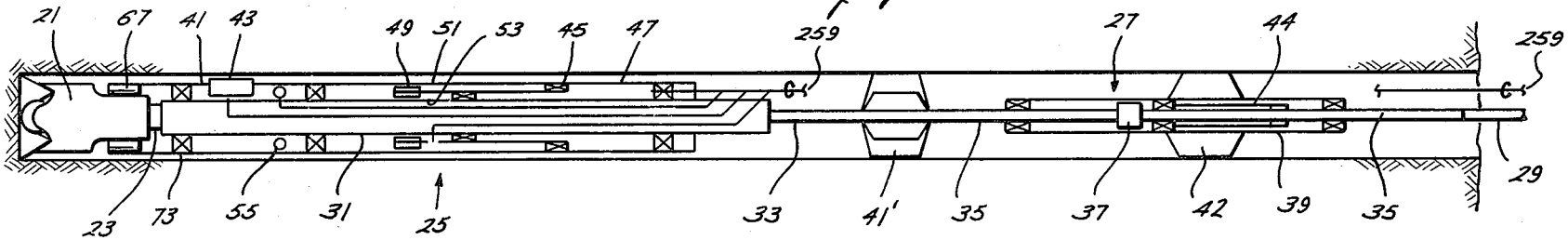
FIG. 1 is a schematic view of a motor with deflection apparatus according to the invention together with associated bit and bit loading apparatus.

Referring now to FIG. 1 there is shown a drill bit 21 connected to the shaft 23 of an in-hole motor 25 which in turn is connected to an in-hole force applicator and counter rotation anchor 27 supplied with fluid from conduit bundle 29. This much of the apparatus is already known, being disclosed in my copending U.S. application Ser. No. 189884 filed Oct. 18, 1971, entitled "Force Applicator," to which reference is made for details of the construction thereof. Briefly, motor 25 is of the fluid turbine type including shaft 23 and housing 31. Fluid for operating the motor and carrying away the drill bit cuttings is supplied via tubular shaft 33, which also serves to transmit axial force to the motor housing 31 and take the reaction torque of the motor. A continuation of shaft 33 provides a tubular mandrel or piston rod 35 which carries piston 37 moving in cylinder 39. Mandrel 35 and cylinder 39 are provided with wall anchor means 41', 42 whereby, with the cylinder anchor means actuated, the piston can apply axial force to the motor, and with the mandrel anchor means actuated, force can be applied to the cylinder to move it axially along the hole. The piston rod is connected to the cylinder by spline means 44 which allows it to move axially while the anchored cylinder prevents piston rod rotation so that the piston rod can take the reaction torque of the in-hole motor.

To direct the drill bit a deflection barrel 41 is provided around the motor, the barrel being provided with asymetrically disposed wall engaging means 43 to urge the motor and bit to one side of the hole. The wall engaging means 43 are adapted to slide longitudinally along the hole as drilling proceeds. The barrel is rotatable about the motor housing to the desired position by means of piston and cylinder actuated key and slot means, the piston being shown at 45, the cylinder at 47, the key at 49, and the slots, not shown, being provided in barrel extension 51 and sleeve 53 attached to the motor housing. A mercury or other type potentiometer 55 transmits electric potentials to an out of the hole Wheatstone bridge (see FIG. 16) to indicate the orientation of the deflection barrel in the hole.

It will be understood that the invention is designed for use in drilling more or less horizontal holes or holes having at least a horizontal component, so that the gravity actuated mercury potentiometer provides an indication of the azimuthal position of the barrel deflection means 43 relative to the hole axis.

Figure 2:
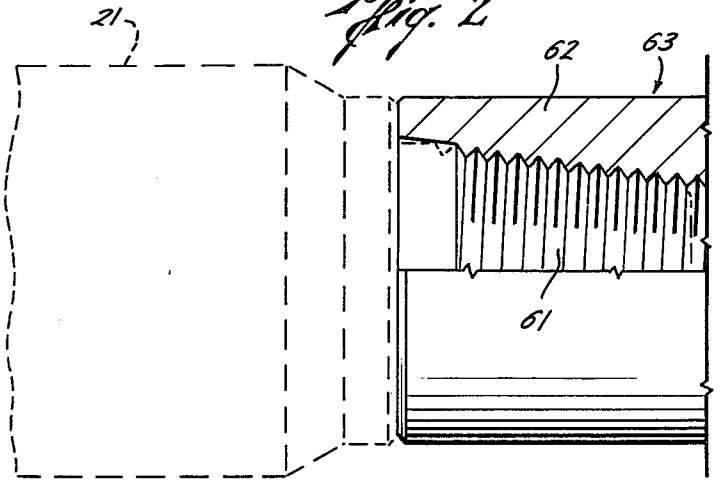
FIGS. 2 through 5 together form a view partly in elevation and partly in section showing an apparatus embodying the invention.
Figures 3, 6, 7, 8:
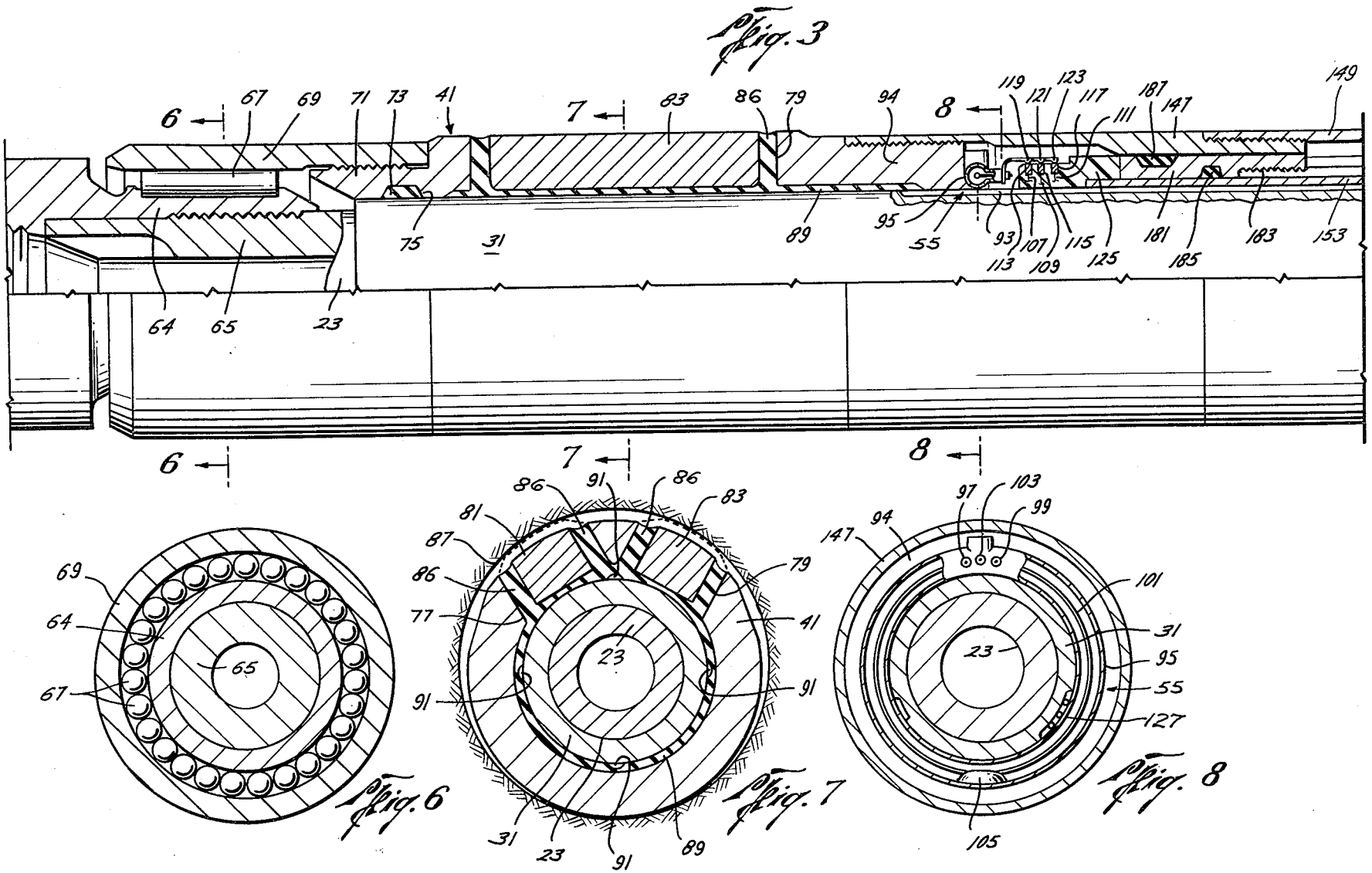
FIGS. 6 through 15 are transverse sections taken through the apparatus shown in FIGS. 2 through 5 at the indicated planes.

Referring now to FIGS. 2 and 3 there is shown drill bit 21 having a pin 61 screwed into box 62 of sub 63. Sub 63 has a box 64 screwed onto the inner end 65 of motor shaft 23. Heavy radial load roller bearings 67 (see also FIG. 6) lie between sub box 64 and cuff 69 which is screwed to the inner end 71 of deflection barrel 41.

Barrel 41, though rotatably mounted on motor housing 31, is sealed thereto by annular elastomeric seal ring 73 disposed in an annular groove 75 in barrel end 71. Referring also to FIG. 7, two windows 77, 79 in the barrel receive hole wall engaging blocks or pistons 81, 83. Between the pistons and the windows is disposed elastomeric mounting means 86 for sealingly mounting the piston in the windows and which allows the pistons to be moved outwardly by pressure differential to engage the wall of hole 87, as shown in dotted lines, and which retracts the pistons from wall engaging positions, as shown in solid lines.

Preferably, the elastomeric mounting means continues around the motor housing 31 forming a bearing sleeve 89 between barrel 41 and motor housing 31. A number of longitudinal grooves 91 on the interior of the sleeve allow fluid to be distributed along the motor housing exterior for lubrication to facilitate rotation of the barrel 41 and sleeve 89 about the motor 31.

Fluid for pushing pistons 81, 83 outwardly is conveyed to the slight annular clearance between bearing sleeve 89 and motor housing 31 by longitudinal groove 93 in the motor housing.

Referring now to FIG. 1, 3, 8 and 16 secured to the outer end 94 of barrel 41 is a potentiometer 55 including an annular electrical conductor tube 95 connected to electrically insulated terminal 103. Within the tube is mounted annular resistance 101 having end terminals 97, 99. A body of mercury 105 inside tube 95 connects the lowermost post of tube 95 with the conductor 101. This potentiometer is of known construction.

To the three terminals 97, 99, 103 are connected electrical conductors 107, 109, 111 by means of slip rings 113, 115, 117, and brushes 119, 121, 123. The slip rings are mounted on insulator ring 125. The insulated conductors 107, 109, 111, extend out along the length of the motor housing in a groove 127 (see FIG. 10) to an out of the hole receiver-indicator next to be described.

Figure 16:
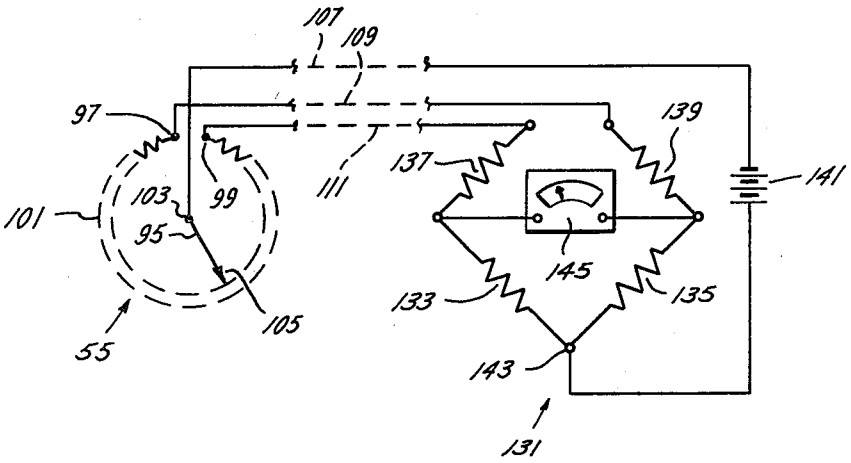
FIG. 16 is a circuit diagram for the remote readout orientation indicator forming part of the apparatus according to the invention.

Referring now to FIG. 16, to indicate the azimuthal position of the deflection barrel relative to the axis of hole 87, conductors 107, 109, 111 are connected to an out of the hole receiver-indicator 131 comprising resistors 133, 135, 137, 139, which, together with resistance 101 form a Wheatstone bridge. A battery 141 applies voltage across points 143, and 103 of the bridge. A galvanometer 145 measures any potential resulting from unbalance of the bridge when the mercury 105 moves to either side of the mid length of tube 95. The galvanometer is calibrated to read in degrees of azimuthal departure of the deflection barrel 41 from a preselected position, e.g., with anchor pistons 81, 83 facing upwardly.

Figures 4, 9, 10, 11:
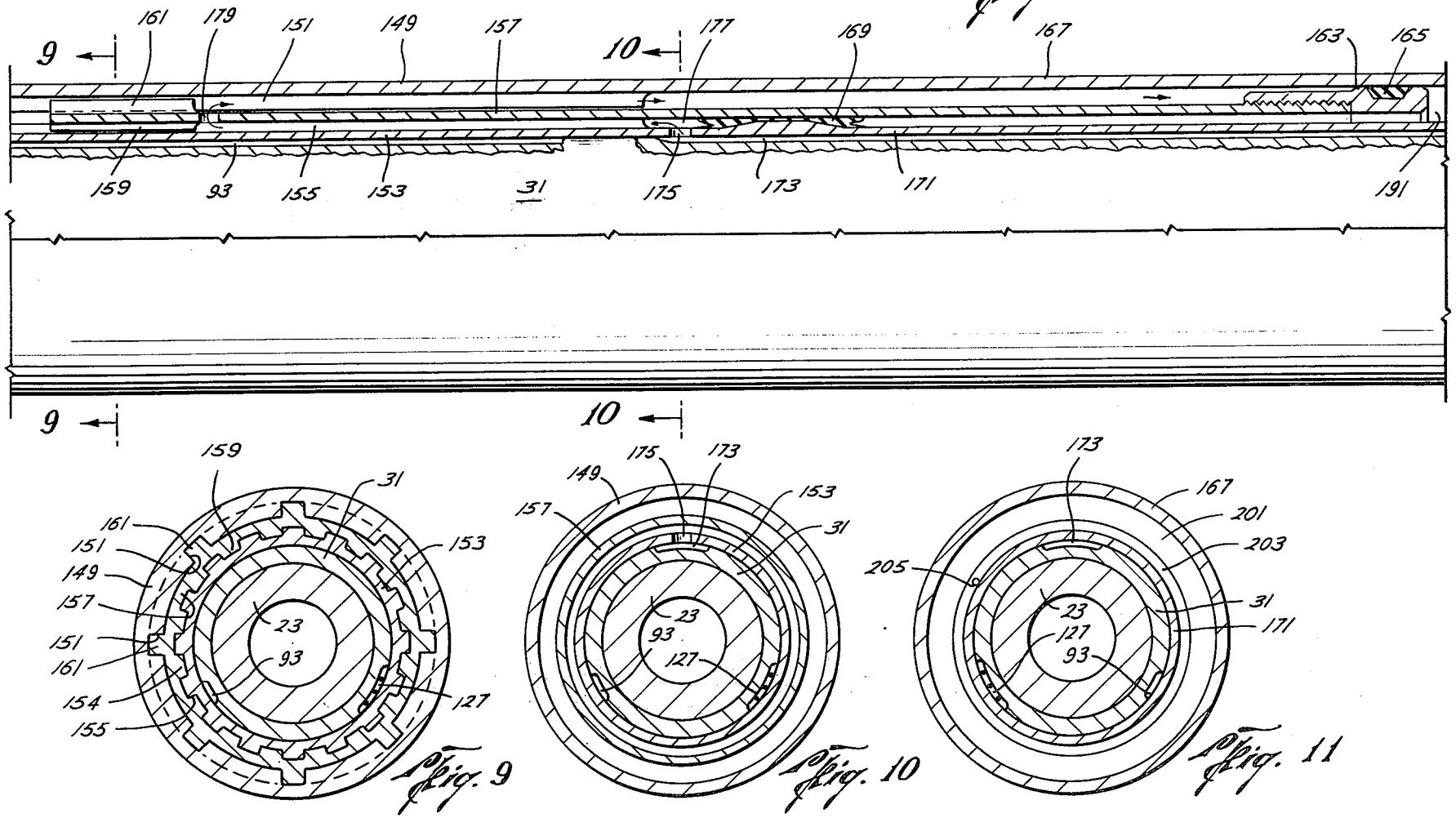

Referring now to FIGS. 3 and 4, to turn the deflection barrel to the desired position azimuthally about the motor housing 31, the barrel is connected by threaded sub 147 to internally fluted tube 149. As shown best in FIG. 9, tube 149 is provided with a plurality of straight, longitudinally extending, grooves or flutes 151. An externally fluted tube 153 is pressed or shrink fitted or otherwise sealed and secured onto the motor housing 31. There are a plurality of helical flutes or grooves 155 extending longitudinally along the outer periphery of tube 153. Annular piston rod 157 disposed between tubes 149, 153, is provided with a plurality of internal and external keys 159, 161 which fit slidably in flutes 151, 155. Depending on the position of keys 159, 161 along the length of tubes 149, 153, the deflection barrel 41 is turned to different positions around motor housing 31.

To move piston rod 157 longitudinally there is an annular piston 163 provided on the outer end of the piston rod. The piston is slidably sealed by annular seal 165 to the cylinder 167 provided by an outward extension of internally fluted tube 149. The annular piston rod is slidably sealed by annular seal 169 to casing 171 formed by an outward extension of externally fluted tube 153. Actuating fluid, e.g., compressed air or pressurized liquid, is introduced to the inner side of piston 163 through a longitudinal groove 173 in motor housing 31, underneath casing 171, and exiting the groove 173 through port 175 (see also FIG. 10) in the casing to the annular space 177 between casing 153 and the annular piston rod 157, inwardly of seal 169. From space 177 the fluid passes through to port 179 in the piston rod 157 and thence to the inner side of piston 163.

The actuating fluid is prevented from exiting the inner end of space 177 by annular seal block 181 screwed to the inner end of externally fluted tube 153 at 183 and sealed thereto by annular seal 185. Block 181 also is sealed to sub 147 by annular seal 187. Slip ring assembly insulator ring 125 is also attached, e.g., with epoxy glue to the inner end of externally fluted tube 153 adjacent seal block 181.

Figures 5, 12, 13, 14, 15:
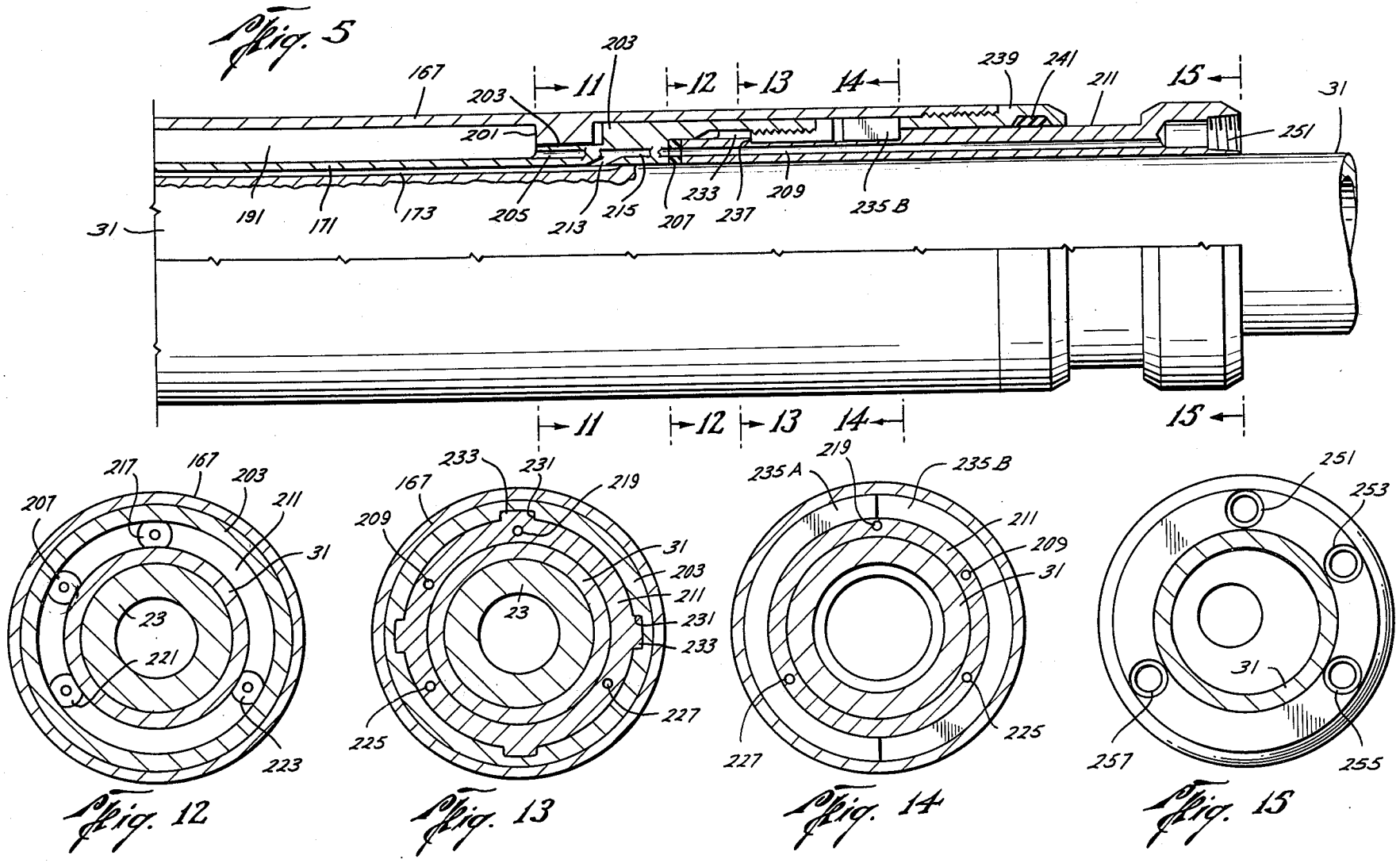

Referring now to FIGS. 4, 5 and 11, the annular space 191 between cylinder 167 ad casing 171 is closed by inturned annular flange 201 on the cylinder and out turned annular flange 203 on the casings. A longitudinal port 205 through flange 203 provides a passage for actuating fluid to the outer side of piston 163. Referring now also to FIG. 12, port 205 terminates at its outer end adjacent an elastomeric seal washer 207 through which fluid may pass to and from longitudinal passage 209 (see also FIG. 13) in annular manifold 211. Washer 207 is set in a socket in the inner end of manifold 211. Fluid passage groove 173 communicates through port 213 in casing 171 with longitudinal passage 215 in flange 203 and thence a similar washer 217 with longitudinal passage 219 (FIG. 13) in manifold 211. Fluid passage groove 93 and electric conductor carrying groove 127 in the motor housing 31 (FIGS. 8–11) in like manner communicate through ports in casing 171 with other longitudinal passages (similar to port 213) in flange 203 and thence through similar washers 221, 223 with longitudinal passages 225, 227 in manifold 211.

Referring now also to FIG. 13, in order to align the passages 209, 219, 225, 227 in manifold 211 with the longitudinal passages in casing flange 203, the latter is provided with internal longitudinal slots 231 receiving longitudinal splines 233 on the outer periphery of the manifold. The manifold is held in place by externally threaded split ring 235A, 235B (see FIG. 14) which is screwed into flange 203 and which bears against a shoulder 237 on the manifold. The end of space 191 is ultimately sealed by nipple 239 screwed into cylinder 167 in sealing engagement therewith and carrying an internal annular seal ring 241 engaging and sealing around manifold 211.

Manifold 211, as shown in FIGS. 5 and 15, is provided at its outer end with threaded sockets 251, 253, 255, 257, for connection to flexible conduits carrying respectively fluid to the inner side of piston 163, to the outer side of piston 163, to the deflection barrel 41, and electricity to the mercury potentiometer 55. These conduits may be bundled together to form a cable 259 (FIG. 1) which extend to the outer end of the hole being bored, running alongside of the force applicator 27, the latter being connected to the motor housing 31 by tubular shaft 33 screwed into the outer end of housing 31.

In operation of the apparatus the motor 25 is actuated by power fluid flowing through shaft 33 and piston rod 35 from hose bundle 29 to rotate bit 21. The bit is forced inwardly against the end of the hole by the force applicator 27. At the same time, the deflection apparatus, including deflection barrel 41, may be actuated to press the bit laterally against the side of the hole in a desired direction. If it is desired only to drill straight ahead, the drill deflection apparatus will not be actuated except as required to correct course. In any case, as drilling proceeds the drill deflection apparatus is carried along in the hole with the in-hole motor. The drilling apparatus may be removed periodically and the hole direction surveyed or direction sensing apparatus may be incorporated in the drilling apparatus to give a continuous indication of hole direction. In either case, if a change of direction is desired the deflection barrel is rotated to set it to press the bit in the desired direction and drilling continued with the deflection barrel active, its pistons being extended, until the desired change in direction is achieved.

The annular piston 163 and the annular cylinder formed by cylinder 167 and casing 171 constitute transducer means for converting fluidic power received via flexible conduits connected to sockets 251, 253 to mechanical power. The term 'transducer' is here used in the sense defined in Webster's Seventh Collegiate Dictionary at page 940, namely "a device that is actuated by power from one system and supplies power in any other form to a second system (as a telephone receiver that is actuated by electric power and supplies acoustic power to the surrounding air)".

While a preferred embodiment of the invention has been shown and described, many modifications thereof will occur to one skilled in the art without departing from the spirit of the invention.

I claim:

1. Drilling apparatus for use with a drill bit, said apparatus comprising:

an in-hole motor including housing and a shaft rotated when said motor is actuated, said shaft being adapted to rotate such drill bit, a deflection barrel mounted around said housing extending from adjacent one end of said motor past the mid point of said motor to adjacent the other end of said motor and rotatable relative thereto about the shaft axis, said barrel including means extendable from the side thereof to engage one side of a hole being drilled and means to push said shaft laterally toward the opposite side of the hole, and positioning means disposed around said housing for turning said barrel about said motor housing to a desired azimuthal position relative to the axis of rotation of said motor shaft and holding it in that position.

2. An in-hole drilling apparatus for use with a drill bit and adapted to be run in a hole being made, said apparatus comprising:

an in-hole motor having a shaft rotated when said motor is actuated, said shaft being adopted to rotate such drill bit.

a deflection barrel rotatable about the shaft axis, said barrel including means extendable from the side thereof to engage one side of a hole being drilled and means to push said shaft laterally toward the opposite side of the hole, and entirely in-hole positioning means for turning said barrel to desired azimuthal position relative to the axis of rotation of said motor shaft and holding it in that position.

3. Drilling apparatus for use with a drill bit, said apparatus comprising:

an in-hole motor including a housing and a shaft, the shaft being rotated when the motor is actuated, said shaft being adapted to rotate such drill bit, a deflection barrel rotatable about the shaft axis, said barrel including means extendable from the side thereof to engage one side of a hole being drilled and means to push said shaft laterally toward the opposite side of the hole, and positioning means operable independent of the rotation of said housing for turning the barrel to a desired azimuthal position relative to the axis of rotation of said motor shaft and holding it in that position.

4. Apparatus according to claim 3 wherein said in-hole motor includes a housing, said deflection barrel is mounted around said housing and said positioning means turns said barrel about said motor housing.

5. Apparatus according to claim 4 wherein said means to push the shaft laterally includes an annular cuff extending inwardly from the barrel and a sub connected to the inner end of the shaft and antifriction bearing means between said cuff and sub.

6. Apparatus according to claim 4 including a bit connected to said shaft and torque anchor means connected to said housing.

7. Apparatus according to claim 6 including force applicator means connected to said housing.

8. Apparatus according to claim 4 wherein said means extendable from the side of the barrel to engage the side of the hole being drilled includes longitudinally spaced apart means to seal between the barrel and motor housing to form an annular pressurable chamber therebetween, and piston means radially extendably and retractably mounted in a window in the barrel adjacent said chamber.

9. Apparatus according to claim 8 wherein said piston is mounted in said window by elastomer means bonded to the piston and window, said elastomer means including a bearing sleeve encircling said motor housing.

10. Apparatus according to claim 4 wherein said positioning means includes an externally fluted tube affixed to the exterior of said motor housing and an internally fluted tube extending from said barrel, at least one of said fluted tubes having helical flutes, and key means engaged with the flutes of said tubes and longitudinally movable therein to turn the barrel extension tube and barrel relative to the housing affixed tube and housing.

11. Apparatus according to claim 10 wherein said actuation means includes piston and cylinder means for moving said key means longitudinally to position the barrel azimuthally in a desired position relative to the motor housing.

12. Apparatus according to claim 11 wherein said piston is annular and coaxially disposed around said motor housing, and said cylinder is an axially outward extension of said internally fluted tube.

13. Apparatus according to claim 12 wherein said piston is connected to said key means by an annular piston rod and said piston and cylinder means further includes annular seal means carried by a casing formed by an axially outward extension of said externally fluted tube to slidingly seal with the inner periphery of said annular piston rod.

14. Apparatus according to claim 13 wherein said command means includes passage means for piston actuating fluid extending through said casing inwardly of said annular seal means and through said annular piston rod communicating with the inner side of said piston.

15. Apparatus according to claim 14 including a manifold at the outer end of said casing and cylinder providing means for connection of fluid conduits for supplying actuating fluid to opposite sides of said piston and to said pressurable chamber.

16. Apparatus according to claim 15 including fluid passages between said casing and motor housing for communicating actuating fluid between said manifold and the inner side of said piston and said pressurable chamber.

17. Apparatus according to claim 16 including transmitter means connected to said barrel responsive to the barrel azimuthal position in the hole being drilled and electrical connections therefrom to transmit information to an out of hole indicator, said connection lying in a groove between said casing and motor housing and connecting to said manifold.

18. Drilling apparatus comprising
an in-hole assembly adapted to be run in a hole being made, said in-hole assembly including,
an in-hole motor having a shaft rotated when the motor is actuated, said shaft to rotate a drill bit,
a deflection barrel rotatable about the shaft axis, said barrel including means extendable from the side thereof to engage one side of a hole being drilled and means to push the shaft laterally toward the opposite side of the hole,
positioning means for turning the barrel to a desired azimuthal position relative to the axis of rotation of the motor shaft and holding it in that position, and
transducer means for moving said positioning means,
said apparatus further comprising
conduit means for suppling power to said transducer means.

19. Apparatus according to claim 18 including transmitting means connected to the barrel responsive to the azimuthal position of the barrel relative to the axis of the hole being drilled for transmitting an indication of the azimuthal position of the barrel to an out of the hole indicator.

20. Apparatus according to claim 19 wherein said transmitter is a mercury potentiometer and including an out of the hole indicator of the Wheatstone bridge type, said potentiometer forming part of the circuit of said bridge.

21. Apparatus according to claim 19 wherein said positioning means and said transmitting means are disposed around said motor inside said barrel.

22. Drilling apparatus comprising:
an in-hole force applicator; and
an in-hole assembly connected to said applicator, said in-hole assembly including:
an in-hole motor having a shaft rotated when said motor is actuated, said shaft to rotate a drill bit,
a deflection barrel rotatable about the shaft axis, said barrel including means extendable from the side thereof to engage one side of a hole being drilled and means to push the shaft laterally toward the opposite side of the hole, and
entirely-in-hole positioning means for turning the barrel to a desired azimuthal position relative to the axis of rotation of said motor shaft and holding it in that position.

23. Drilling apparatus comprising:
an in-hole force applicator; and
an in-hole assembly connected to said applicator, said in-hole assembly including:
an in-hole motor provided with a shaft rotated when said motor is actuated, said shaft, being adapted to rotate a drill bit;
a deflection barrel rotatable about the shaft axis, said barrel including means extendable from the side thereof to engage one side of a hole being drilled and means to push the shaft laterally toward the opposite side of the hole,
positioning means for turning the barrel to a desired azimuthal position relative to the axis of rotation of said motor shaft and holding it in that position, and
transducer means for moving said positioning means;
said apparatus further comprising
conduit means for supplying power to said transducer means.

* * * * *

UNITED STATES PATENT AND TRADEMARK OFFICE

CERTIFICATE OF CORRECTION

PATENT NO. : 3,997,008

DATED : DECEMBER 14, 1976

INVENTOR(S) : JACKSON M. KELLNER

It is certified that error appears in the above-identified patent and that said Letters Patent are hereby corrected as shown below:

Column 1, line 24, change "of" (first occurrence) to -- at --; change "of" (second occurrence to -- to --.

Column 1, line 49, change "U.S," to -- U.S. --.

Column 4, line 31, change "ad" to -- and --.

Column 5, line 67, change "adopted" to -- adapted --.

Column 8, line 34, after "shaft" delete -- , --.

Column 8, line 35, change ";" to -- , --.

Column 5, line 4, change "extend" to -- extends --.

Column 7, line 32, after "comprising" insert -- : --.

Column 8, line 20, after "said shaft" insert -- being adapted --.

Signed and Sealed this

Twenty-second Day of March 1977

[SEAL]

*Attest:*

RUTH C. MASON
*Attesting Officer*

C. MARSHALL DANN
*Commissioner of Patents and Trademarks*